US005908063A

United States Patent [19]

Gobidas

[11] Patent Number: 5,908,063

[45] Date of Patent: Jun. 1, 1999

[54] SAFETY CORD PULL APPARATUS

[75] Inventor: Raphael A. Gobidas, 2253 Professor St., Cleveland, Ohio 44113

[73] Assignee: Raphael A. Gobidas, Cleveland, Ohio

[21] Appl. No.: 08/891,319

[22] Filed: Jul. 9, 1997

Related U.S. Application Data

[ 60] Provisional application No. 60/043,773, Apr. 11, 1997.

[51] Int. Cl.[6] ..... E06B 9/30

[52] U.S. Cl. ..... 160/178.1 R; 160/168.1 R; 160/173 R; 160/900; 24/115 F; 24/115 R; 24/132 R; 16/208

[58] Field of Search ..... 160/168.1 R, 173 R, 160/178.1 R, 900; 24/115 R, 115 F, 122.6, 132 R, 715.4; 16/208, DIG. 42

[56] References Cited

U.S. PATENT DOCUMENTS

| | | | |
|---|---|---|---|
| 3,854,179 | 12/1974 | Montoya | 28/2 |
| 4,032,052 | 6/1977 | Bates, Jr. | 223/46 |
| 4,909,298 | 3/1990 | Langhart et al. | 160/178.1 R |
| 5,068,949 | 12/1991 | Horace | 24/115 R |
| 5,473,797 | 12/1995 | Wu | 160/178.1 R X |
| 5,494,092 | 2/1996 | Georgopoulos | 160/178.1 |
| 5,542,461 | 8/1996 | Huang | 160/178.1 |
| 5,553,650 | 9/1996 | Jelic | 160/178.1 |
| 5,562,140 | 10/1996 | Biba | 160/178.1 R |
| 5,577,543 | 11/1996 | Jelic | 160/178.1 |
| 5,592,983 | 1/1997 | Sartini et al. | 160/178.1 R |
| 5,715,884 | 2/1998 | Cotten | 24/115 F X |
| 5,735,329 | 4/1998 | Akins et al. | 160/178.1 R |

*Primary Examiner*—Daniel P Stodola
*Assistant Examiner*—Bruce A Lev
*Attorney, Agent, or Firm*—Emerson & Associates; Roger D. Emerson; Timothy D. Bennett

[57] ABSTRACT

A safety cord-pull apparatus having a top portion and a bottom portion which include raised waves to secure control cords from a blind. A razor blade molded into the cord-pull apparatus cuts the control cords in the event a child or small pet becomes entangled within the control cords. An alternate cord-pull apparatus is also provided which has a circular housing through which the control cords are disposed. The control cords are cut by a sharpened edge in a cap on the housing or by a sharpened washer located inside the housing. The cord-pull apparatus also includes a pull cord that hangs below the control cord-pull apparatus to operate a blind.

19 Claims, 7 Drawing Sheets

SAFETY CORD PULL APPARATUS

This application claims the benefit of U.S. Provisional Application, Ser. No. 60/043,773, filed on Apr. 11, 1997, in Express Mail Label No. EM138087786 by the same inventor, Mr. Raphael A. Gobidas, entitled SAFETY CORD PULL APPARATUS.

BACKGROUND OF THE INVENTION

1. Field of Invention

This invention pertains to the art of methods and apparatuses for raising and lowering window blinds and similar devices, and more specifically to methods and apparatuses for improving the safety of blinds and shades by providing an apparatus to convert multiple control cords to one pull cord and to provide an apparatus that cuts through the control cords in the event a small child or pet becomes entangled in the control cords thereby reducing the chance of strangulation.

2. Description of the Related Art

In the past, blinds and shades have used a plurality of control cords that hang down from the head rail of the blind or shade to raise and lower the blind. These cords were typically connected at the bottom. A problem can arise in that small children and pets can get tangled up in the cords, presenting a risk of strangulation.

Applicant recognized the need to develop an apparatus that would eliminate or reduce the risk of strangulation of a small child or pet in the cords of a blind without requiring engineering of new blinds or reengineering of existing blinds. Applicant also recognized the need develop the apparatus at cost effectively and providing acceptable reliability and appearance.

The present invention contemplates a new and improved cord pull apparatus which is simple in design, effective in use, and overcomes the foregoing difficulties and others while providing better and more advantageous overall results.

SUMMARY OF THE INVENTION

In accordance with the present invention, a new and improved cord-pull apparatus is provided which eliminates or reduces the risk of strangulation to a small child or pet without requiring engineering of new blinds or reengineering of existing blinds.

More particularly, in accordance with the present invention, the cord-pull apparatus for use with control cords of a blind includes a top portion having a plurality of first raised waves, a bottom portion operatively connected to the top portion at a fold line, the bottom portion having a plurality of second raised waves, a first cutting means molded into the top portion having at least one serration, all but one the control cords being placed within at least one serration, a clipping apparatus for securing the top portion to the bottom portion, and a pull cord thread a hole in the bottom portion.

According to one aspect of the present invention, the method of assembling a cord-pull apparatus for use with control cords of a blind includes the step of placing the control cord into cord chutes, placing the control cords over the second raised waves, folding the top portion onto the bottom portion so that the first raised waves oppose the second raised waves, engaging the clipping apparatus to secure the top portion to the bottom portion, adjusting the control cords to level the blind, feeding the control cords through an opening in the bottom portion, engaging the clipping apparatus a second time to fixedly secure the top portion and the bottom portion, and cutting the control cords.

According to another aspect of the present invention, the cord-pull apparatus for use with control cords of a blind includes a housing having a top and a bottom, a cap attached to the top housing, a cap having a first hole for receiving control cords, a base attached to the bottom of the housing, the base having a second hole, the base having a pull cord disposed through the second hole, and a cutting apparatus for cutting the control cords.

According to another aspect of the present invention, the cord-pull apparatus for use with control cords of a blind includes a top portion having a plurality of first raised waves, a bottom portion operatively connected to the top portion at a fold line, the bottom portion having a plurality of second raised waves, a razor blade molded into the top portion, a clipping apparatus for securing the top portion to the bottom portion, and a pull cord thread through a hole in the bottom portion.

One advantage of the present invention is its effectiveness against strangulation of small children and pets in that the control cords cannot be spread apart and weight placed against the cords without the cords being cut loose.

Another advantage of the present invention is that pulling all the cords in one direction will not cause the control cords to be cut.

Another advantage of the present invention is that the cord-pull apparatus may be produced economically without engineering new blinds or reengineering existing blind designs.

Another advantage of the present invention is that its speeds the manufacturing process of the blinds or shades.

Still other benefits and advantages of the invention will become apparent to those skilled in the art to which it pertains upon a reading and understanding of the following detailed specification.

BRIEF DESCRIPTION OF THE DRAWINGS

The invention may take physical form in certain parts and arrangement of parts, a preferred embodiment of which will be described in detail in this specification and illustrated in the accompanying drawings which form a part hereof and herein.

DESCRIPTION OF THE PREFERRED EMBODIMENT

Figure 1:
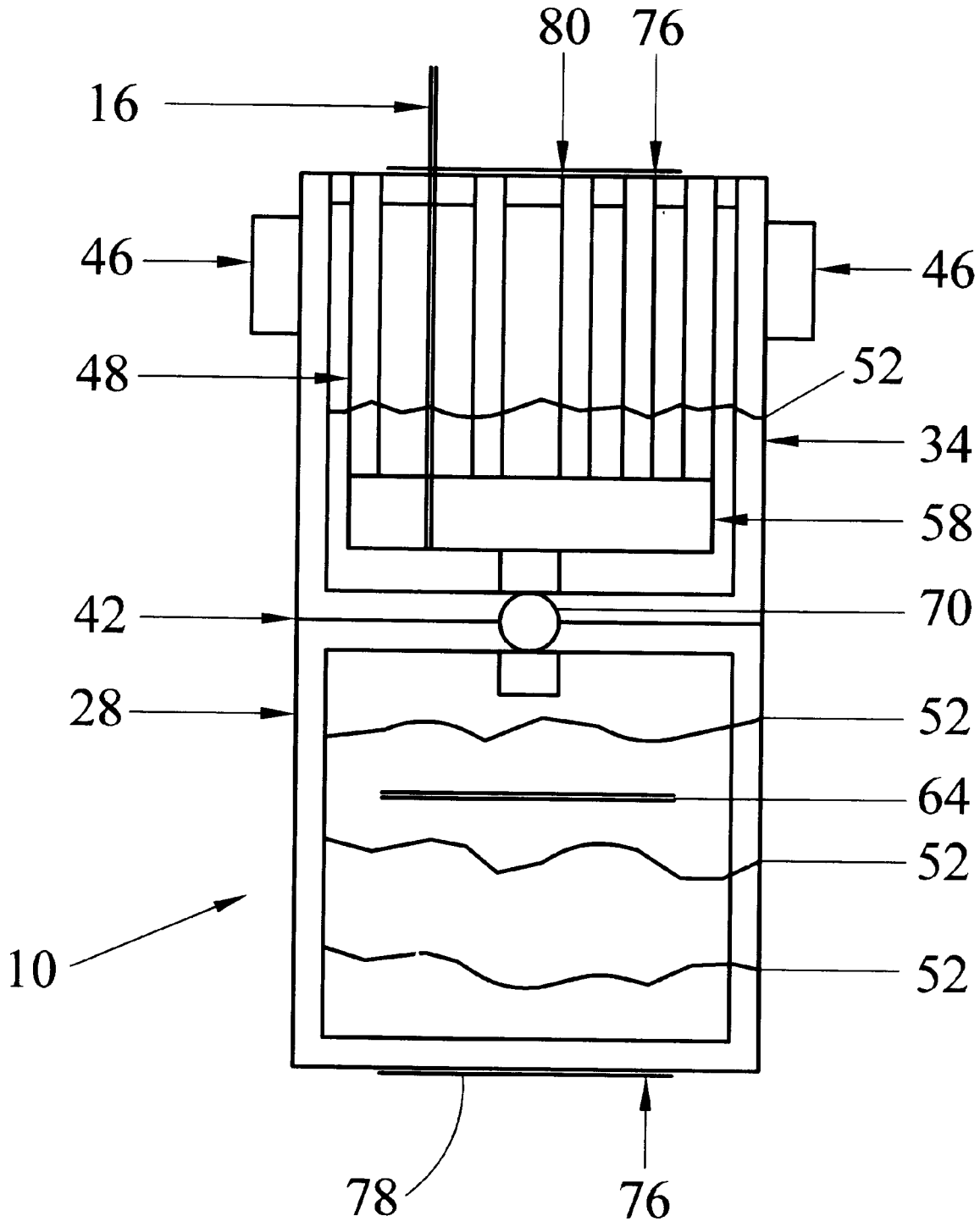
FIG. 1 is a top view of an unassembled cord-pull apparatus.
Figure 2:
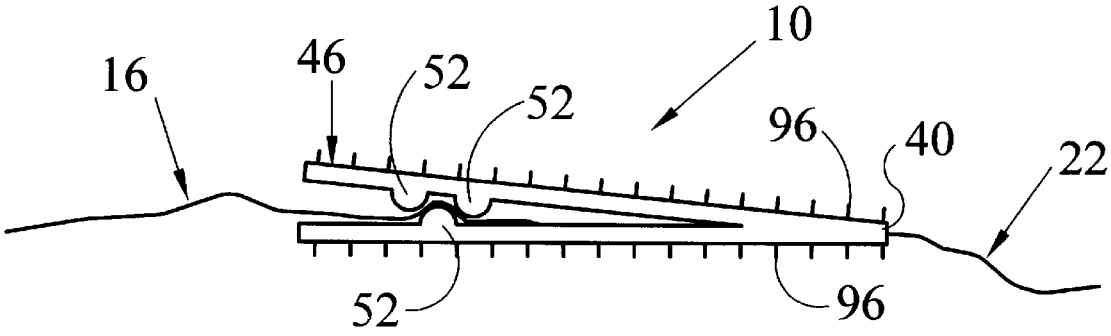
FIG. 2 is a side view of an assembled cord-pull apparatus.

Referring now to the drawings wherein the showings are for purposes of illustrating a preferred embodiment of the invention only and not for purposes of limiting the same, FIG. 1 shows a top view of an unassembled cord-pull apparatus and FIG. 2 a side view of an assembled cord-pull apparatus 10 for use with horizontal blinds and pleated shades. While the invention is disclosed with reference to a cord for use with a blind or pleated shades in other sorts of similar window treatments, in fact, the invention has much wider applicability. The invention could be used and can deliver the described benefits, when used with any sort of device which includes a cord which presents a risk of strangulation. Control cords 16 hang from the head rail of the blind to allow the blind to be raised and lowered. Many blinds contain several control cords 16 that are connected together at the bottom of the control cords 16. Small children and pets can get caught up in the control cords 16 in such a manner as to present a risk of strangulation. The cord-pull apparatus 10 acts as a buffer between the control cords 16 and a single pull cord 22. The cord-pull apparatus 10 also cuts loose all but one of the control cords 16 in the event a lateral movement of the cord-pull apparatus 10 occurs because a child or pet becomes entangled in the control cords 16.

The cord-pull apparatus 10 is a two-part apparatus containing a top portion 28 and a bottom portion 34, as best viewed in FIG. 2. The top portion 28 and bottom portion 34 may be attached at the bottom end 40 of the cord-pull apparatus 10, or the portions 28,34 may be molded from a single piece of plastic or any other suitable material. To assemble the cord-pull apparatus 10, the top portion 28 is folded on top of the bottom portion 34 along fold line 42 and attached to the bottom portion 34 with clipping means such as clips 46. Prior to assembly, the control cords 16 are placed into cord chutes 48 across the top end 80 of the bottom portion 34 of the cord-pull apparatus 10, as best viewed in FIG. 1. Raised waves 52 molded into the top and bottom portions 28,34 act to hold the control cords 16 in place when the cord-pull apparatus 10 is assembled, as seen in FIG. 2.

After the control cords 16 are placed into the chutes 48, the top portion 28 of the cord-pull apparatus 10 is folded over on top of bottom portion 34 so that the raised waves 52 engage the control cords 16 and the clips 46 are engaged a first time. The control cords 16 are then adjusted to level the blind. The control cords 16 are then fed through opening 58 and the clips 46 are snapped a second time to secure the cord-pull apparatus 10. The excess length of control cords 16 fed through opening 58 may be cut off manually or cut by cutting means 64 for cutting embedded in top portion 28 when the top and bottom portions 28,34 are snapped together. The preferred cutting means 64 is a razor blade, although other similar sharp objects can be incorporated. The rest of the disclosure will refer to a razor blade although it should be understood that other cutting means can be used. The razor blade 64 is preferably located between raised waves 52 to prevent accidental injury during assembly.

A single pull cord 22 is fed through a preferably circular opening 70 to raise and lower the blind. A knot in the pull cord 22 preferably holds the pull cord in place.

A serrated razor blade 76 is preferably molded into either the top end 78 of the top portion 28 or the top end 80 of the bottom portion 34 of the cord-pull apparatus 10. The control cords 16 preferably fit in between the serrations of the serrated razor blade 76. Vertical movement of the cord-pull apparatus 10 prevents the control cords 16 from contacting the serrations of the serrated razor blade 76. However, lateral movement of the control cords 16, such as what may occur if a child or pet becomes entangled in the control cords 16, causes the control cords 16 to come in contact with the serrations of the serrated razor blade 76, thereby cutting the control cords 16. In the preferred embodiment, one of the control cords 16 is not placed in the serrations of the serrated razor blade 76, or a portion of the serrated razor blade 76 may be blunted. Therefore, all but one of the control cords 16 are cut by lateral movement of the cord-pull apparatus 10. This prevents the entire blind from being rendered inoperative and prevents the control-pull apparatus 10 and pull cord 22 from falling to the floor where they may present a further danger to a small child or pet.

The cord-pull apparatus 10 is preferably made of molded plastic. The cord-pull apparatus 10 may be further coated by or made out of a bad tasting plastic to make it less attractive to the taste of a child or pet who may try to swallow it in the event the cord-pull apparatus 10 inadvertently becomes disassembled from the all of the control cords 16. For example, the bad taste may be something very bitter so that it is unattractive to the child or pet. The control cords 16 and pull cord 22 are also preferably made of or coated with bad tasting material to prevent a child from swallowing them. The cord-pull apparatus 10 also contains bristles 96 extending outwardly from the top and bottom portions 28,34 to prevent a child from holding the apparatus 10.

Figure 3:
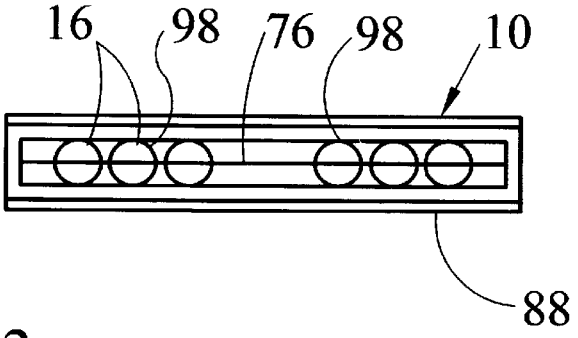
FIG. 3 is a top view of the assembled cord-pull apparatus of FIG. 2.

FIG. 3 shows a top of the assembled cord-pull apparatus 10. The control cords 16 exit the top 88 of the cord-pull apparatus 10. The serrations 98 of the razor blade 76 are also visible in FIG. 3. The serrations 98 are preferably rounded to conform to the shape of the control cords 16. The serrations 98 may also be described as undulations in the razor blade 76.

Figure 4:
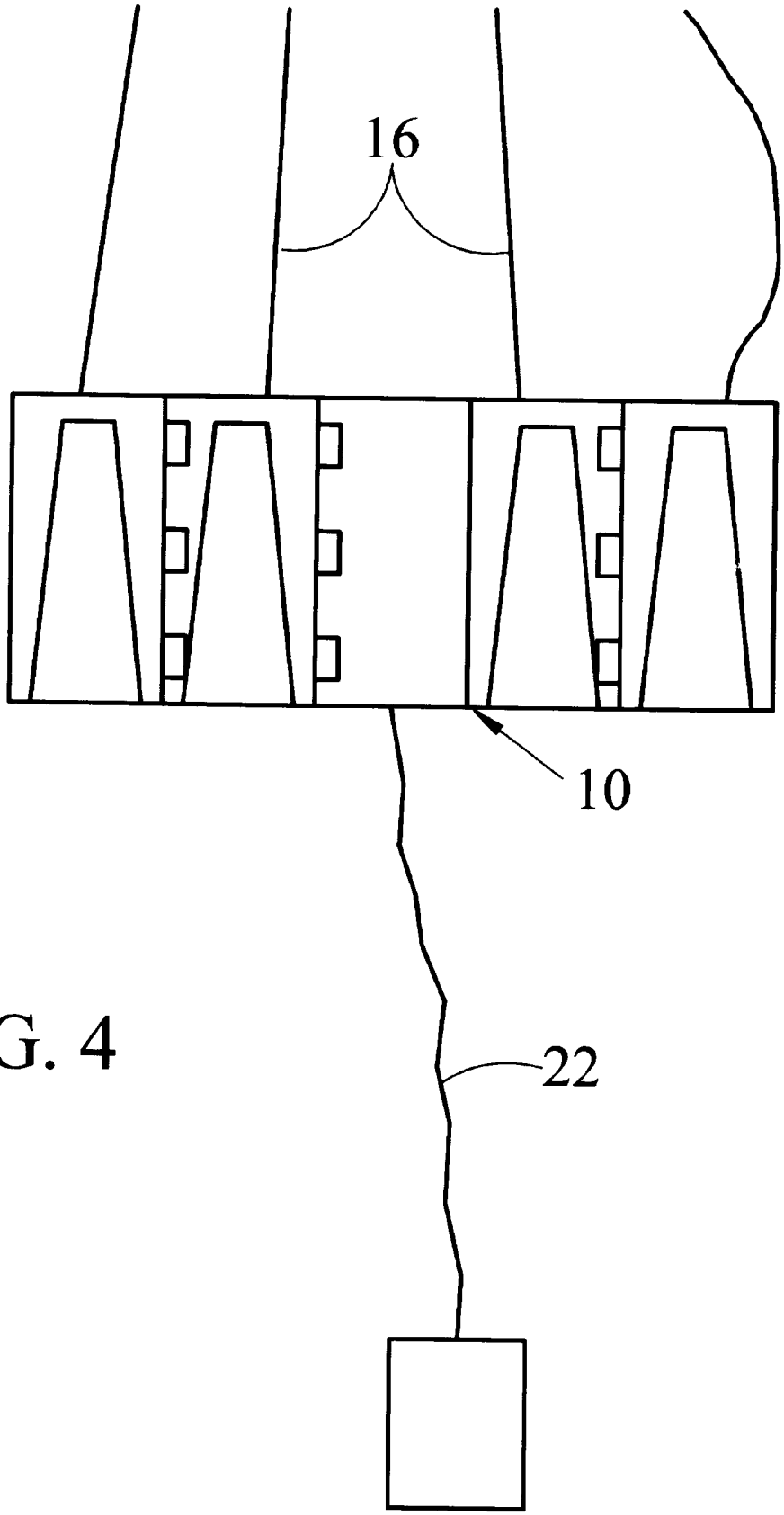
FIG. 4 is a perspective view of the assembled cord-pull apparatus, control cords, and pull cord.

FIG. 4 shows a view of a cord-pull apparatus 10 hanging from control cords 16. The single pull cord 22 hangs below the cord-pull apparatus 10 and is used by an individual to raise and lower the blind or shade.

The cord-pull apparatus 10 is preferably retrofittable to an existing blind, or may be produced with a new blind.

Figure 5:
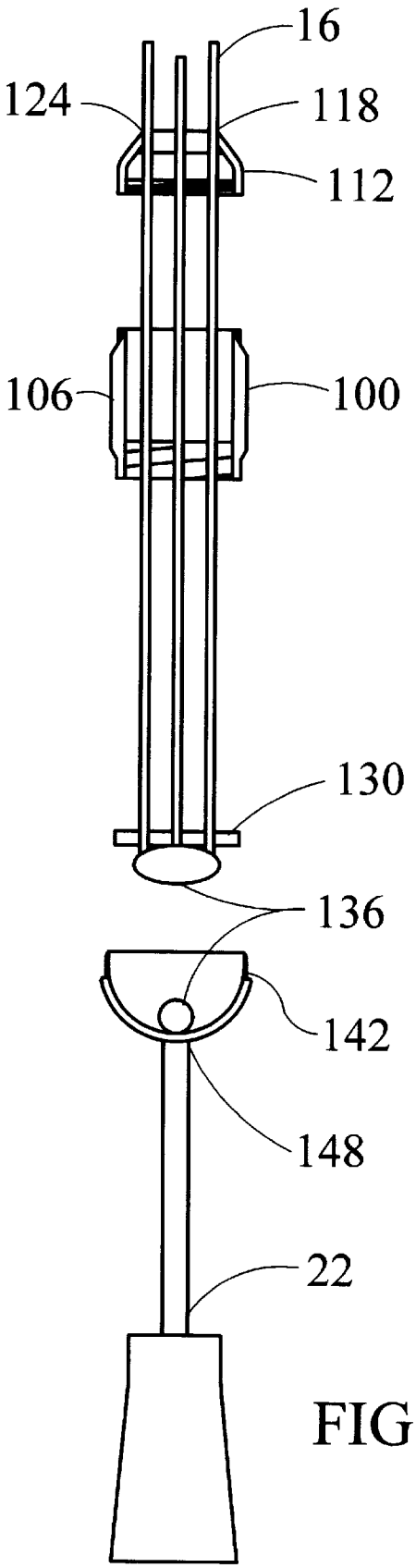
FIG. 5 is a side view of an alternate embodiment of an unassembled cord-pull apparatus.

FIG. 5 shows an alternative embodiment of a cord pull apparatus 100 hanging from control cords 16. The single pull cord 22 hangs below the cord-pull apparatus 100 and is used by an individual to raise and lower the blind or shade. The cord pull apparatus 100 preferably includes a cylindrical housing 106 through which the pull cords 16 are threaded. The pull cords 16 are also threaded through a cap 112 that fits on top of the housing 106. The cap 112 preferably is threaded, and the top of the housing 106 is also preferably threaded, therefore enabling the cap 112 to be screwed on top of the housing 106. The pull cords 16 are threaded through a hole 118 in the top of the cap 112. The hole 118 is preferably encircled by a cutting means 124 which cuts the cords 16 in the event that the cords 16 are laterally moved, such as when a child or pet becomes entangled within the cords 16. In this embodiment, the preferred cutting means is simply a sharpened edge of the cap 112, although other cutting means may be used.

The cords 16 are preferably held in place by a retaining means 130. The preferred retaining means 130 is a washer, and the rest of the disclosure will be made to reference to the washer although other retaining means could be used. The cords 16 are threaded through the washer 130 and tied into a knot 136 below the washer 130. The cord-pull apparatus 100 also has a base 142 which is threaded to correspond with the threaded bottom of the housing 106. The base 142 has hole 148 through which the pull cord 22 is threaded and secured by a knot 136.

Figure 6:
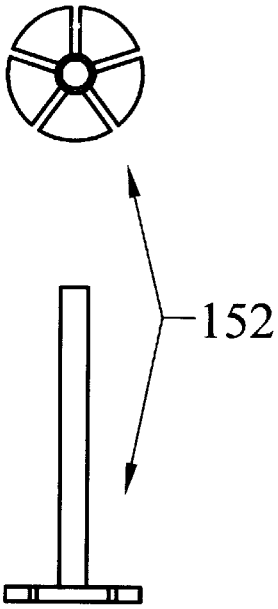
FIG. 6 is a side view and top view of a bushing or sheath which may protect a control cord in the assembled cord-pull apparatus of FIG. 5.

As shown in FIG. 6, the washer 130 may be replaced with a bushing or sheath 152 through which one of the control cords 16 is threaded. The bushing or sheath 152 prevents one of the control cords 16 from being cut by the sharpened edge 124 of the cap 112 upon lateral movement of the cord-pull apparatus 100, thereby ensuring that the cord-pull apparatus 100 will not become disengaged from a blind.

Figure 7:
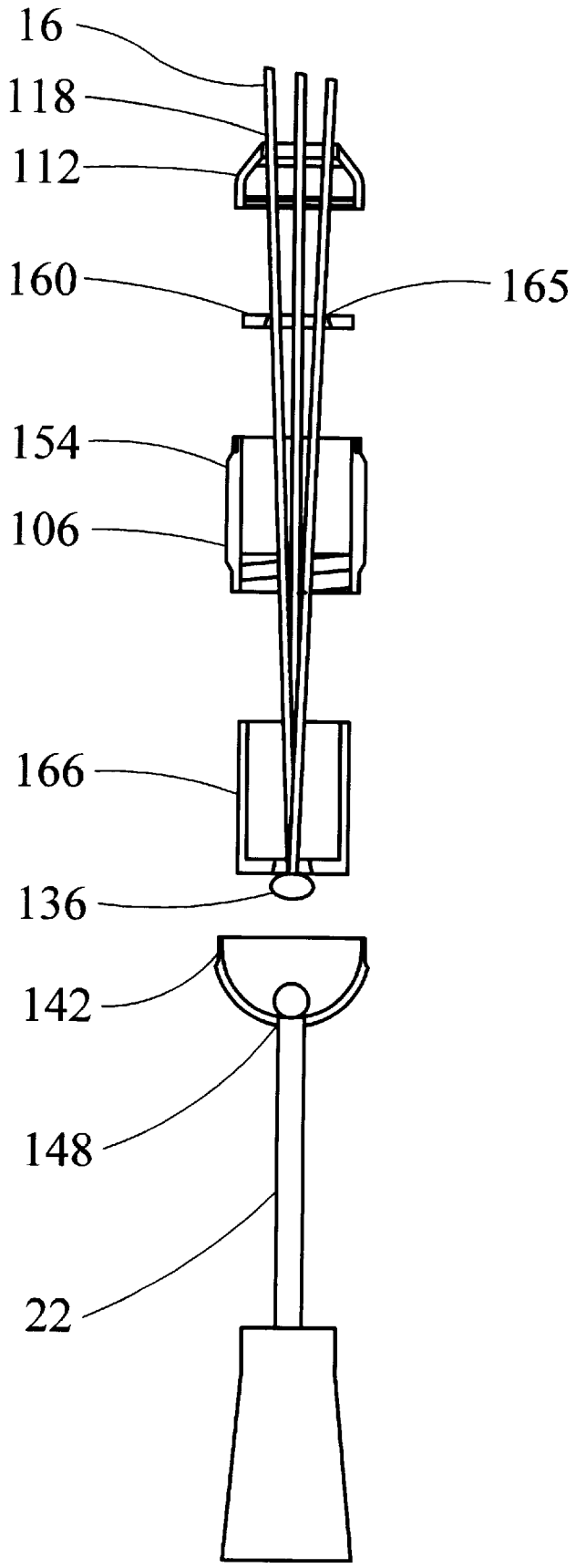
FIG. 7 is another embodiment of an unassembled cord-pull apparatus.

FIG. 7 shows another embodiment of the cord-pull apparatus 154. The cord-pull apparatus 154 includes a washer 160 with a cutting means 165 that cuts the control cords 16 upon lateral movement of the cord-pull apparatus 154. The preferred cutting means 165 in this embodiment is a sharpened inner edge of the washer, although other cutting means could be employed. The washer 160 sits on top of a cylindrical bushing 166. The cylindrical bushing 166 further sits inside of the housing 106. The control cords 16 are once again threaded through a hole 118 within the cap 112 that screws on top of the housing 106. The control cords are then threaded through a hole in the cylindrical bushing 166 and secured by a knot 136. The cord-pull apparatus 154 also includes a base 142 that further holds the cylindrical bushing 166 in place. A pull cord 22 is threaded through a hole 148 in the bottom of the base 142 and secured to the base by a knot 136. As with the previous embodiment, a sheath or bushing 152 may be included around one of the control cords 16 as viewed in FIG. 6. This prevents one of the control cords 16 from being cut upon lateral movement of the cord-pull apparatus 154.

Figure 8:
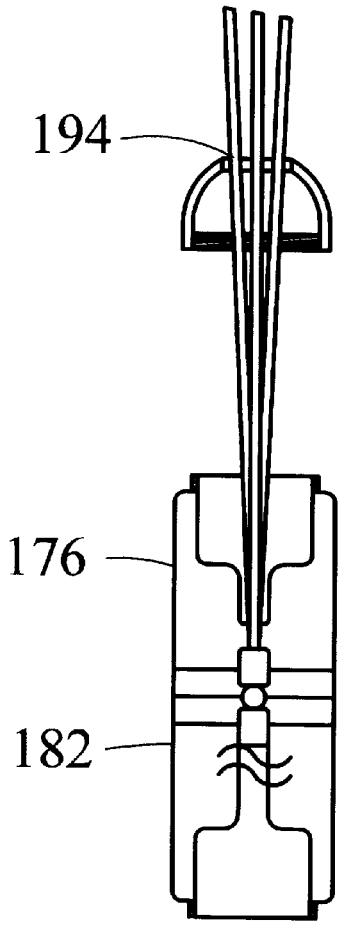
FIG. 8 is a top view of an other embodiment of an unassembled cord-pull apparatus.

FIG. 8 shows another embodiment of a cord-pull apparatus 170. The cord-pull apparatus 170 is similar to the embodiment shown in FIGS. 1–4. However, the top portion 176 and bottom portion 182 include raised circular portions.

Figure 9:
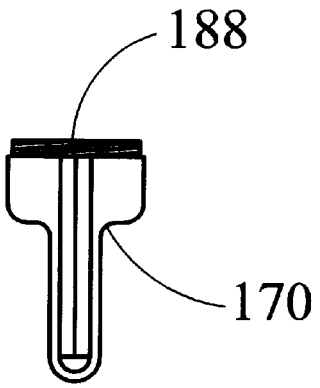
FIG. 9 is a side view of the assembled cord-pull apparatus of FIG. 8.

FIG. 9 shows the cord-pull apparatus 170 folded with a rounded or circular top 188. A cap 194 fits over the top 188 when assembled to secure the top portion 176 and bottom portion 182 together. The control cords 16 are threaded through the cap 194.

Figure 10:
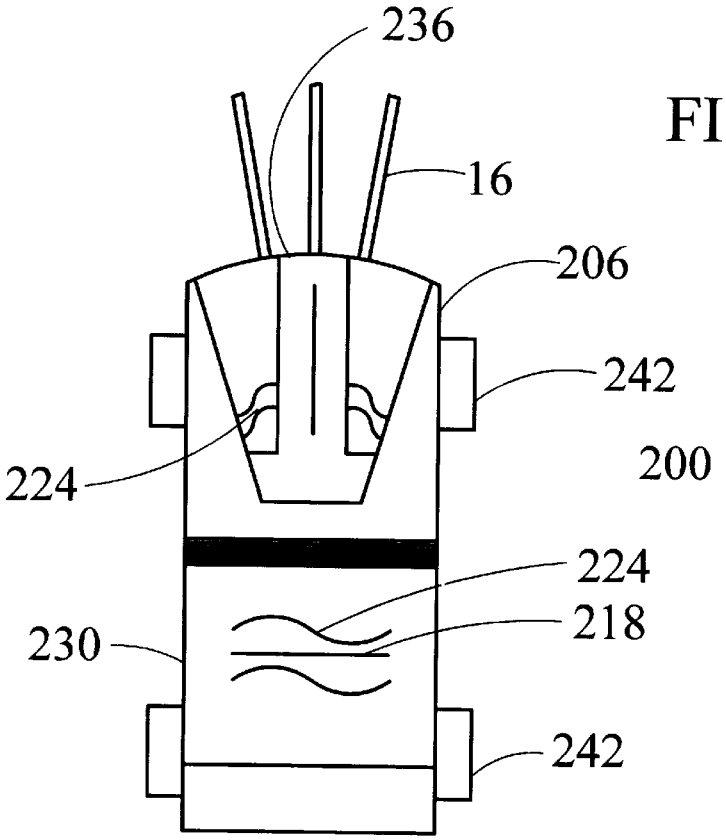
FIG. 10 is a top view of another embodiment of an unassembled cord-pull apparatus; and, FIG. 11 is a top view of the assembled cord-pull apparatus of FIG. 10.

FIG. 10 shows a preferred embodiment of the present invention. The cord-pull apparatus 200 is assembled similarly to the embodiments shown in FIGS. 1–4. The top portion 206 of the cord-pull apparatus 200 is preferably curved.

Figure 11:
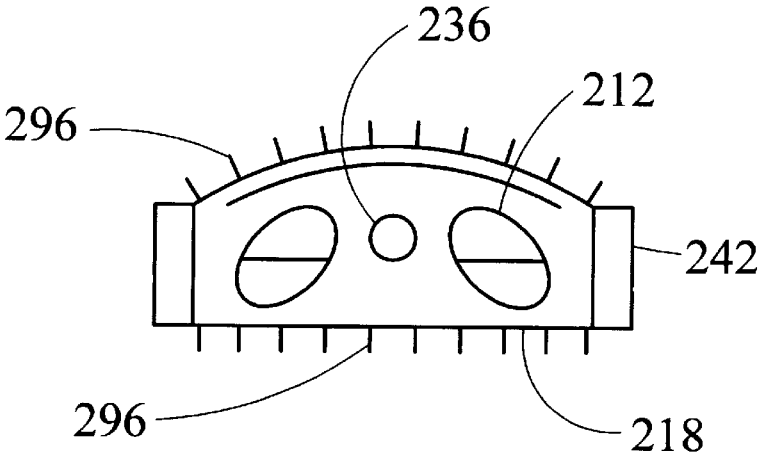

With continuing reference to FIG. 10, FIG. 11 shows a top view of the assembled cord-pull apparatus 200. The top portion 206 preferably has holes 212 through which the control cords 16 are threaded. A cutting means, such as a razor blade or sharp edge 218, is located between raised waves 224 and the top portion 206 and bottom portion 230 of the cord-pull apparatus 200. Upon lateral movement of the cord-pull apparatus 200, the control cords 16 are thrust against the razor blade 218 and cut. One of the control cords 16 is preferably threaded through a rail 236 which prevents contact with the razor blade 218. Therefore, one of the control cords 16 remains uncut to prevent complete disassembly of the blind and cord-pull apparatus 200. When assembled, the cord-pull apparatus 200 may be held together by a hinge, clip 242, or any other suitable clipping mechanism.

The cord-pull apparatus 200 preferably is made of molded plastic material that is bad tasting. Also, the cord-pull apparatus 200 preferably has bristle 296 that make the cord-pull apparatus 200 difficult to touch the cord-pull apparatus 200 is preferably retrofittable to an existing blind, or may be produced with a new blind.

The preferred embodiments have been described, hereinabove. It will be apparent to those skilled in the art that the above methods may incorporate changes and modifications without departing from the general scope of this invention. It is intended to include all such modifications and alterations in so far as they come within the scope of the appended claims or the equivalents thereof.

I claim:

1. A cord pull apparatus for use with a plurality of associated control cords, the cord pull apparatus comprising:

a housing having a top and a bottom;

a cap attached to said top of said housing, said cap having a first hole for receiving said plurality of associated control cords;

a base attached to said bottom of said housing said base having a second hole, said base having a pull cord disposed through said second hole; and, cutting means for cutting all but one of said associated control cords, said cutting means including a washer, said washer having an inner circular surface and an outer circular surface, said inner circular surface being sharpened; and, a sheath disposed around a portion of said inner circular surface of said washer.

2. A cord pull apparatus for use with a plurality of associated control cords, the cord pull apparatus comprising:

a housing having a top and a bottom;

a cap attached to said top of said housing, said cap having a first hole for receiving said plurality of associated control cords;

a base attached to said bottom of said housing, said base having a second hole, said base having a pull cord disposed through said second hole; and, cutting means for cutting all but one of said associated control cords, said cutting means including a sharpened surface on said cap surrounding said first hole in said cap; and, a sheath disposed around a portion of said sharpened surface.

3. A cord pull apparatus for use with a plurality of associated control cords, the cord pull apparatus comprising:

a top portion having a plurality of first raised waves;

a bottom portion operatively connected to said top portion at a fold line said bottom portion having a plurality of second raised waves;

a cutting means molded into said top portion for use in cutting all but one of said plurality of associated control cords;

clipping means for securing said top portion to said bottom portion;

a pull cord threaded through a hole in said bottom portion; and, a rail for use in receiving one of said plurality of associated control cords.

4. A cord pull apparatus for use with a plurality of associated control cords, the cord pull apparatus comprising:

a top portion having a plurality of first raised waves;

a bottom portion operatively connected to said top portion at a fold line, said bottom portion having a plurality of second raised waves, said top portion and said bottom portions having bristles extending outwardly to make said apparatus difficult to hold;

a cutting means molded into said top portion for use in cutting all but one of said plurality of associated control cords;

clipping means for securing said top portion to said bottom portion; and, a pull cord threaded through a hole in said bottom portion.

5. A cord pull apparatus for use with a plurality of associated control cords the cord pull apparatus comprising:

a top portion having a plurality of first raised waves;

a bottom portion operatively connected to said top portion at a fold line, said bottom portion having a plurality of second raised waves, said top portion and said bottom portions having bristles extending outwardly to make said apparatus difficult to hold;

a first cutting means molded into said top portion having at least one serration, said first cutting means for use in selectively cutting all but one of said plurality of associated control cords;

clipping means for securing said top portion to said bottom portion; and, a pull cord threaded through a hole in said bottom portion.

6. A cord pull apparatus for use with a plurality of associated control cords, the cord pull apparatus comprising:

a top portion;

a bottom portion having a plurality of cord chutes for use in receiving the plurality of associated control cords;

first cutting means for use in selectively cutting all but one of said plurality of associated control cords; and, securing means for securing said top portion to said bottom portion.

7. The cord pull apparatus of claim 6 further comprising:

first and second raised waves for use in holding the associated control cords within said plurality of cord chutes, said first and second raised waves being positioned on said top and bottom portions, respectively.

8. The cord pull apparatus of claim 6 wherein said top and bottom portions are attached at a bottom end of the cord pull apparatus, the cord pull apparatus further comprising:

a pull cord that is operatively connected to an opening in said bottom end of the cord pull apparatus.

9. The cord pull apparatus of claim 6 wherein said first cutting means comprises:

a blade having a plurality of serrations, each of said plurality of serrations being positioned adjacent to one of said plurality of cord chutes, one of said plurality of serrations being blunted.

10. The cord pull apparatus of claim 6 further comprising:

second cutting means for use in selectively cutting excess length of said plurality of associated control cords.

11. The cord pull apparatus of claim 10 wherein said bottom portion has an opening positioned below said plurality of cord chutes for use in receiving said excess length of said plurality of associated control cords.

12. The cord pull apparatus of claim 11 wherein said plurality of cord chutes have first and second ends, said first cutting means being positioned at said first ends of said plurality of cord chutes, said second cutting means being positioned at said second ends of said plurality of cord chutes.

13. The cord pull apparatus of claim 6 further comprising:

a plurality of bristles extending from said top and bottom portions.

14. The cord pull apparatus of claim 6 wherein said securing means comprises:

a cap that is selectively attachable to said top and bottom portions, said cap having a hole for use in receiving the plurality of associated control cords.

15. The cord pull apparatus of claim 6 wherein said first cutting means comprises:

a rail that extends between said top and bottom portions for use in receiving said one of said plurality of associated control cords.

16. A cord pull apparatus for use with a plurality of associated control cords, the cord pull apparatus comprising:

a housing having a top and a bottom, said housing having a first hole for use in receiving the plurality of associated control cords;

a cap that is selectively attachable to said top of said housing, said cap having a second hole for use in receiving the plurality of associated control cords;

a base that is selectively attachable to said bottom of said housing;

retaining means for use in retaining the plurality of associated control cords in place within said housing; and, cutting means for use in selectively cutting all but one of said plurality of associated control cords.

17. The cord pull apparatus of claim 16 wherein said retaining means provides said cutting means, said retaining means comprising:

a washer, said washer having an inner circular surface and an outer circular surface, said inner circular surface being sharpened; and, a sheath disposed around a portion of said inner circular surface of said washer.

18. The cord pull apparatus of claim 16 wherein said cutting means comprises:

a sharpened surface on said cap surrounding said second hole; and, a sheath disposed around a portion of said sharpened surface.

19. The cord pull apparatus of claim 16 further comprising:

a pull cord that is operatively connected to an opening in said base.

* * * * *